US012070657B2

(12) United States Patent
Komatsu

(10) Patent No.: US 12,070,657 B2
(45) Date of Patent: Aug. 27, 2024

(54) GOLF BALL AND METHOD OF MANUFACTURE

(71) Applicant: BRIDGESTONE SPORTS CO., LTD., Tokyo (JP)

(72) Inventor: Atsushi Komatsu, Saitamaken (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 18/074,819

(22) Filed: Dec. 5, 2022

(65) Prior Publication Data

US 2023/0173346 A1 Jun. 8, 2023

(30) Foreign Application Priority Data

Dec. 6, 2021 (JP) ..... 2021-197470

(51) Int. Cl.
*A63B 37/06* (2006.01)
*A63B 37/00* (2006.01)

(52) U.S. Cl.
CPC .... *A63B 37/00622* (2020.08); *A63B 37/0011* (2013.01); *A63B 37/0023* (2013.01)

(58) Field of Classification Search
CPC ..... A63B 37/005; A63B 37/0062
See application file for complete search history.

(56) References Cited

U.S. PATENT DOCUMENTS

2003/0209840 A1* 11/2003 Hogge ..... B29C 35/0805 264/492
2007/0087865 A1* 4/2007 Shannon ..... A63B 37/0015 473/378
2013/0090189 A1* 4/2013 Felker ..... A63B 37/0064 473/383
2015/0018124 A1 1/2015 Ishii et al.
2015/0018126 A1 1/2015 Ishii et al.
2015/0018127 A1 1/2015 Ishii et al.

* cited by examiner

*Primary Examiner* — Raeann Gorden
(74) *Attorney, Agent, or Firm* — Sughrue Mion, PLLC

(57) ABSTRACT

A golf ball is provided which suppresses twisting due to external forces while maintaining sufficient deflection at the time of impact, reduces the spin rate without lowering ball rebound, and is thus able to effectively increase the distance traveled by the ball, particularly on shots with a driver. In the golf ball, which includes a core and a cover, the core has a core body made of a first polybutadiene rubber and having a surface with a plurality of groves or holes thereon, which grooves or holes are filled with a second polybutadiene rubber of a differing composition from the first polybutadiene rubber. The polybutadiene rubber-filled groove portions or hole portions have a higher surface hardness than the core body.

4 Claims, 2 Drawing Sheets

GOLF BALL AND METHOD OF MANUFACTURE

CROSS-REFERENCE TO RELATED APPLICATION

This non-provisional application claims priority under 35 U.S.C. § 119(a) on Patent Application No. 2021-197470 filed in Japan on Dec. 6, 2021, the entire contents of which are hereby incorporated by reference.

TECHNICAL FIELD

The present invention relates to a golf ball having a core and a cover, and more particularly to a golf ball whose spin rate on shots with a driver is suitably lowered, enabling the distance traveled by the ball to be increased. The invention also relates to a method for manufacturing such a golf ball.

BACKGROUND ART

Various modifications in the construction of golf ball cores have hitherto been proposed with the aim of improving the ball performance. For example, numerous disclosures in which the core is given a two-layer construction have been made in the art. In addition, US. Patent Application Publication Nos. 2015-0018127, 2015-0018124 and 2015-0018126 disclose art in which the core is given a structure having a plurality of raised and recessed areas on the core surface.

At the same time, there is a very strong desire for an increased distance, particularly on shots with a driver. To this end, it is effective to reduce the spin rate on driver shots. In order to reduce the spin rate, it is effective to lower ball twist due to external forces by increasing the surface hardness of the core or the cover. However, making the core or cover harder also has the effect of reducing ball deflection, which lowers the rebound and thus lowers the initial velocity on impact, as a result of which a sufficient increase in distance cannot be achieved.

Accordingly, there exists a desire for innovations which suppress twisting of the golf ball due to external forces while maintaining a sufficient ball deflection on impact and which reduce the spin rate of the ball without lowering the ball rebound, thus increasing the distance traveled by the ball. However, in the above-mentioned prior-art innovations that give the core a two-layer structure or provide the core surface with recessed areas, it is not easy to both maintain a good deflection and suppress twist. Hence, a desire exists for the development of art which, by both providing the ball with a good deflection and suppressing twist, is able to effectively increase the distance traveled by the ball.

SUMMARY OF THE INVENTION

As can be seen from the above, the hardness and deflection of a golf ball core have a mutually incompatible relationship in the prior art; it has been difficult to achieve both of these and to reduce the spin rate without lowering the ball rebound. A major unresolved issue thus has to do with the distance increasing effects arising from improvements in the core.

It is therefore an object of the present invention to provide a golf ball which suppresses twist due to external forces while maintaining a sufficient deflection at the time of impact and which reduces the spin rate without lowering ball rebound, and is thus able to effectively increase the distance traveled by the ball.

As a result of intensive investigations, I have found that, in a golf ball having a core made of a polybutadiene rubber and a cover, by forming a plurality of grooves or holes at the surface of the core and filling these grooves or holes with another polybutadiene rubber that is harder than the core body, the ball when struck suppresses twisting due to external forces while maintaining a sufficient deflection and reduces the spin rate without lowering ball rebound, thus enabling the distance of the ball to be effectively increased.

Accordingly, in a first aspect, the invention provides a golf ball having a core and a cover, wherein the core has a core body made of a first polybutadiene rubber and having a surface with a plurality of groves or holes thereon, which grooves or holes are filled with a second polybutadiene rubber of a differing composition from the first polybutadiene rubber, and wherein the polybutadiene rubber-filled groove portions or hole portions have a higher surface hardness than the core body.

In a preferred embodiment of the golf ball of the invention, the surface hardness of the groove portions or hole portions and the surface hardness of the core body have a difference therebetween, expressed in terms of JIS-C hardness, of from 1 to 20.

In another preferred embodiment of the inventive golf ball, the grooves or holes formed at the core surface have a depth of from 0.2 to 2 mm.

In yet another preferred embodiment of the inventive golf ball, the grooves or holes formed at the core surface have a total surface area which accounts for between 10% and 50% of the core surface area.

In still another preferred embodiment of the inventive golf ball, the holes formed at the core surface are cylindrical holes.

In a further preferred embodiment of the inventive golf ball, the grooves formed at the core surface are arranged as a grid.

In a yet further preferred embodiment of the inventive golf ball, mutually adjoining grooves or holes have intervals therebetween of from 2 to 10 mm.

In a still further preferred embodiment of the inventive golf ball, the cover has a hardness which is higher than the surface hardness of the groove portions or hole portions of the core.

In an additional preferred embodiment of the inventive golf ball, the cover hardness and the surface hardness of the groove portions or hole portions of the core have a difference therebetween, expressed in terms of JIS-C hardness, of from 1 to 25.

In a second aspect, the invention provides a method for manufacturing the golf ball according to the first aspect, which method includes the steps of:

producing a core body that is made of a first polybutadiene rubber and has a surface with a plurality of grooves or holes thereon;

filling the grooves or holes formed at the surface of the core body with a second polybutadiene rubber having a higher hardness than the surface hardness of the core body so as to produce a core having a smooth spherical surface; and forming a cover around the core, either directly on the core or over an intervening intermediate layer.

In a preferred embodiment of the foregoing method of manufacture, the core body is produced by vulcanizing/molding the first polybutadiene rubber under applied pressure in a mold having a cavity with a plurality of ridges or projections formed therein, at which time the ridges or projections are transferred to the surface of the core body, forming the plurality of grooves or holes.

In another preferred embodiment of the method of manufacture, the core body is produced by vulcanizing/molding the first polybutadiene rubber under applied pressure to form a sphere, and subsequently machining a plurality of grooves or holes in the surface of the sphere.

In still another preferred embodiment of the method of manufacture, the core in which the plurality of grooves or holes formed at the surface of the core body are filled with a polybutadiene rubber having a higher hardness than the surface hardness of the core body is produced by placing a pair of half-cups formed of the second polybutadiene rubber over the core body so as to encase it, vulcanizing/molding the second polybutadiene rubber under applied pressure, and subsequently abrading the surface of the second polybutadiene rubber encasing the core body until the surface of the core body is exposed.

Advantageous Effects of the Invention

The golf ball of the invention suppresses twisting due to external forces while maintaining sufficient deflection when the ball is struck, reduces the spin rate without lowering ball rebound, and is thus able to effectively increase the distance traveled by the ball, particularly on driver shots.

BRIEF DESCRIPTION OF THE DIAGRAMS

DESCRIPTION OF THE PREFERRED EMBODIMENTS

Figure 1:
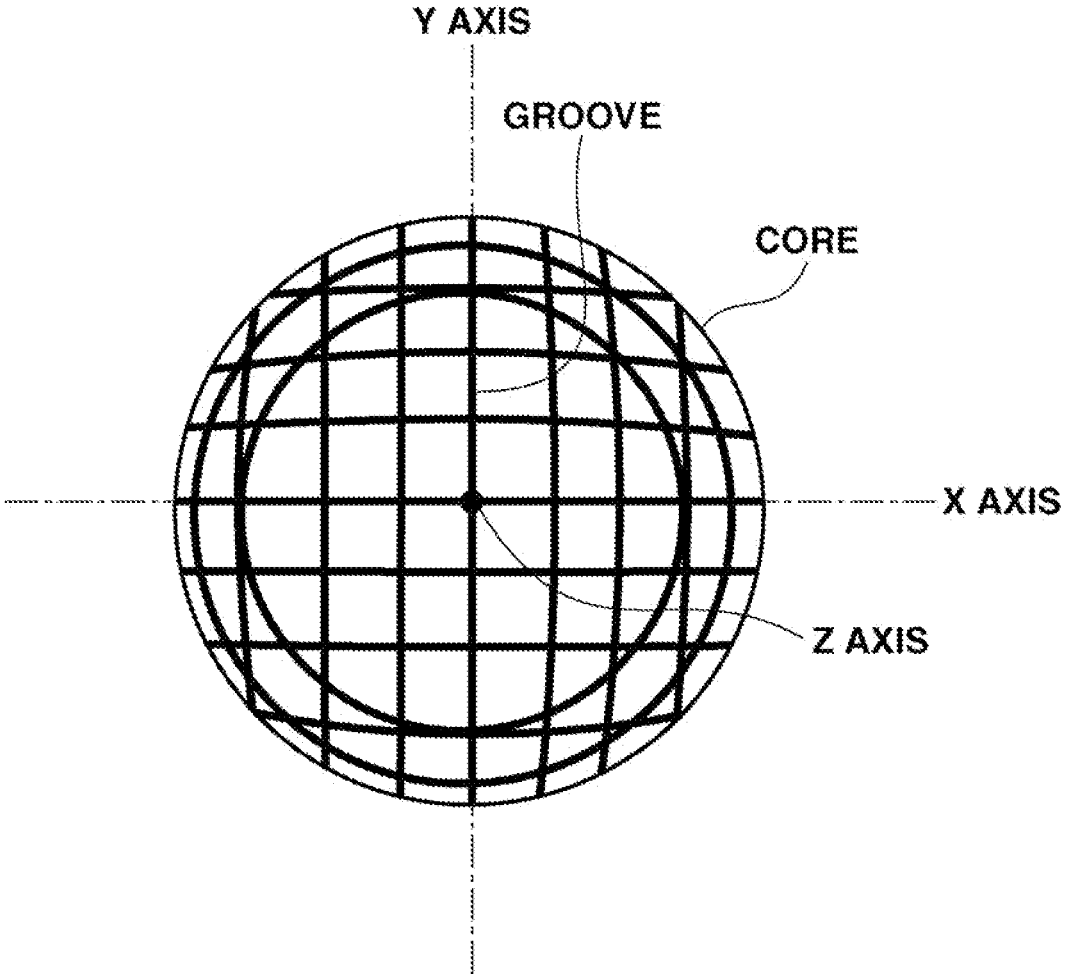
FIG. 1 is a front view showing an example according to the invention in which a plurality of grooves are formed in the core surface.

The objects, features and advantages of the invention will become more apparent from the following detailed description taken in conjunction with the appended diagrams.

The golf ball of the invention has a core and a cover. As mentioned above, a plurality of grooves or holes are formed on the surface of the core body made of a first polybutadiene rubber, and the grooves or holes are filled with a second polybutadiene rubber of a higher hardness than the core body.

As noted above, the core used in the inventive golf ball is made of a first polybutadiene rubber and is constructed of a core body having a plurality of grooves or holes formed in the surface and a rubber filler made of a second polybutadiene rubber filled into these grooves or holes.

The core body and rubber filler are each made of polybutadiene rubber and can be produced using rubber compositions containing primarily polybutadiene rubber as the base rubber, to which have been added a co-crosslinking agent, an organic peroxide, an inert filler, an organosulfur compound and the like.

Exemplary co-crosslinking agents include unsaturated carboxylic acids and metal salts of unsaturated carboxylic acids. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids include, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is typically least 5 parts by weight, preferably at least 9 parts by weight, and more preferably at least 13 parts by weight. The amount included is preferably not more than 60 parts by weight, more preferably not more than 50 parts by weight, and even more preferably not more than 40 parts by weight. Too much may make the core too hard, giving the ball an unpleasant feel at impact, whereas too little may lower the rebound.

A commercially available product may be used as the organic peroxide. Examples of such products that may be suitably used include Percumyl D, Perhexa C-40 and Perhexa 3M (all from NOF Corporation), and Luperco 231XL (from AtoChem Co.). One of these may be used alone, or two or more may be used together. The amount of organic peroxide included per 100 parts by weight of the base rubber is preferably at least 0.1 part by weight, more preferably at least 0.3 part by weight, even more preferably at least 0.5 part by weight, and most preferably at least 0.6 part by weight. The upper limit is preferably not more than 5 parts by weight, more preferably not more than 4 parts by weight, even more preferably not more than 3 parts by weight, and most preferably not more than 2.5 parts by weight. When too much or too little is included, it may not be possible to obtain a golf ball having a good feel, durability and rebound.

In addition, an inert filler may be added as a compounding ingredient to the base rubber. Inert fillers that may be suitably used include, for example, zinc oxide, barium sulfate and calcium carbonate. One of these may be used alone, or two or more may be used together. The amount of inert filler included per 100 parts by weight of the base rubber is preferably at least 40 parts by weight, and more preferably at least 50 parts by weight. The upper limit per 100 parts by weight of the base rubber is preferably not more than 90 parts by weight, and more preferably not more than 80 parts by weight. Too much or too little inert filler may make it impossible to obtain a proper weight and a suitable rebound.

The purpose of the organosulfur compound is to increase the golf ball rebound. Examples include thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and any of the following having 2 to 4 sulfur atoms: diphenylpolysulfides, dibenzylpolysulfides, dibenzoylpolysulfides, dibenzothiazoylpolysulfides and dithiobenzoylpolysulfides. The use of the zinc salt of pentachlorothiophenol is especially preferred.

The amount of organosulfur compound included per 100 parts by weight of the base rubber is preferably 0 part by weight or more, more preferably 0.05 part by weight or more, and even more preferably 0.1 part by weight or more. The upper limit is preferably not more than 5 parts by weight, more preferably not more than 3 parts by weight, and even more preferably not more than 2.5 parts by weight. When too much organosulfur compound is included, a further rebound improving effect (especially on shots with a W #1) is unlikely to be obtained, the overall core may become too soft, or the feel at impact may worsen. On the other hand, when too little is included, a good rebound improving effect is unlikely to be obtained.

Commercial products such as Nocrac NS-6 and Nocrac NS-30 (both available from Ouchi Shinko Chemical Industry Co., Ltd.) and Yoshinox 425 (Yoshitomi Pharmaceutical Industries, Ltd.) may be used as an antioxidant. One of these may be used alone, or two or more may be used together.

The amount of antioxidant included per 100 parts by weight of the base rubber is preferably 0 part by weight or more, more preferably 0.05 part by weight or more, and even more preferably 0.1 part by weight or more. The upper limit is preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable rebound and durability.

In this invention, as mentioned above, the hardness of the second polybutadiene rubber making up the rubber filler (surface hardness of groove portions or hole portions) is set higher than the hardness of the first polybutadiene rubber making up the core body (surface hardness of core body). Adjustment of the polybutadiene rubber hardness, although not particularly limited, may be carried out by adjusting the content of the co-crosslinking agent.

The surface hardness of the core body, expressed in terms of the JIS-C hardness, is preferably 65 or more, more preferably 70 or more, and even more preferably 75 or more. The upper limit is preferably not more than 95, more preferably not more than 90, and even more preferably not more than 85. This surface hardness, expressed as the Shore D hardness, is preferably 41 or more, more preferably 45 or more, and even more preferably 49 or more. The upper limit is preferably not more than 64, more preferably not more than 60, and even more preferably not more than 57. When this value is too large, the durability to cracking on repeated impact may worsen. On the other hand, when this value is too small, the spin rate on full shots may rise, as a result of which the intended distance may not be achieved.

The surface hardness of the groove portions or hole portions is set higher than the surface hardness of the core body and, expressed in terms of JIS-C hardness, is preferably 70 or more, more preferably 75 or more, and even more preferably 79 or more. The upper limit is preferably not more than 98, more preferably not more than 94, and even more preferably not more than 91. This surface hardness, expressed on the Shore D scale, is preferably 45 or more, more preferably 49 or more, and even more preferably 52 or more. The upper limit is preferably not more than 66, more preferably not more than 63, and even more preferably not more than 61.

The difference between the surface hardness of the groove portions or hole portions and the surface hardness of the core body is not particularly limited. On the JIS-C hardness scale, the difference is preferably 1 or more, more preferably 3 or more, and even more preferably 7 or more. The upper limit is preferably not more than 20, more preferably not more than 17, and even more preferably not more than 15.

The shape or form of the grooves or holes formed in the core is not particularly limited, provided that the grooves or holes are uniformly arranged over the entire core surface. For example, when forming grooves, it is preferable for the plurality of grooves to be arranged in a grid and for the grooves to be evenly and uniformly present over the entire surface of the core. By way of illustration, the grooves may be arranged in a grid like that shown in FIG. 1. In this example, three mutually orthogonal axes—an x-axis, a y-axis and a z-axis—are established on the core, lines of latitude (parallels) with respect to each of these three axes are evenly created, and grooves are formed along these parallels.

Figure 2:
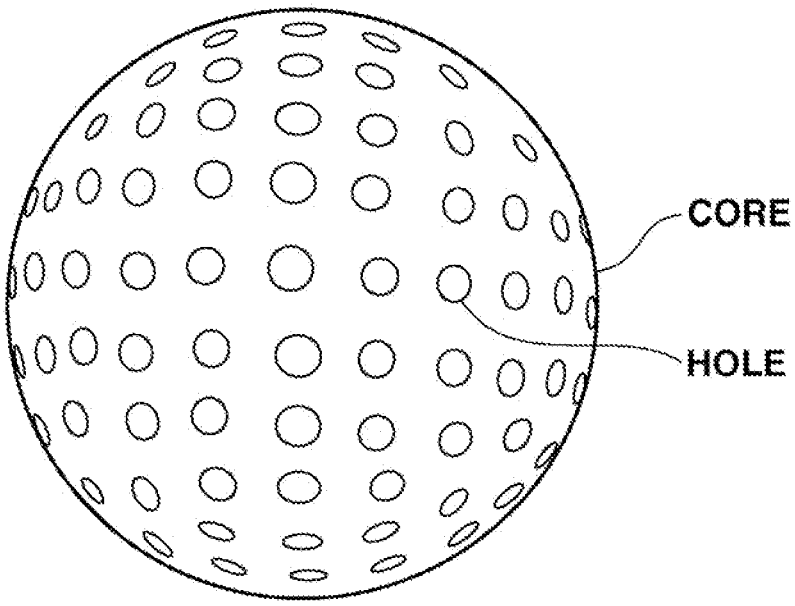
FIG. 2 is a front view showing an example according to the invention in which a plurality of holes are formed in the core surface.

The holes formed in the core should have a cylindrical shape which extends from the surface toward the center of the core, the cross-sectional shape of the hole being, for example, circular, quadrangular or polygonal. Alternatively, holes of a plurality of shapes may be combined, although cylindrical holes having a circular cross-sectional shape are generally preferred. No limitation is imposed on the arrangement of these holes, which may be evenly and uniformly situated over the entire surface of the core. The holes may be arranged, for example, as shown in FIG. 2.

The depth of the grooves or holes is not particularly limited and may be suitably set according to, for example, the size of the core, the hardnesses of the core body and the filled rubber, and the hardness difference therebetween. However, the depth is preferably 0.2 mm or more, more preferably 0.3 mm or more, and even more preferably 0.4 mm or more. The upper limit is preferably not more than 2 mm, more preferably not more than 1.6 mm, and even more preferably not more than 1.2 mm.

The number of grooves or holes is not particularly limited and is suitably set according to, for example, the sizes of the grooves or holes and the size of the core. The grooves or holes have a total surface area which accounts for 10% or more, more preferably 14% or more, and even more preferably 17% or more, of the core surface area. The upper limit in the proportion of the core surface area occupied by the grooves or holes is preferably not more than 50%, more preferably not more than 46%, and even more preferably not more than 43%. The grooves or holes have a spacing with adjoining grooves or holes that is preferably 2 mm or more, more preferably 3 mm or more, and even more preferably 4 mm or more. The upper limit in this spacing is preferably not more than 10 mm, more preferably not more than 8 mm, and even more preferably not more than 6 mm.

Production of the core entails first using a rubber composition composed primarily of the above-described first polybutadiene rubber to produce the core body. Preferred use can be made of a method which involves, for example, heating and compressing the rubber composition in the usual manner at a temperature of at least 140° C. and not more than 180° C. for a period of at least 10 minutes and not more than 60 minutes to form the core body. The method of forming the grooves and holes in this core body is not particularly limited. For example, use can be made of a method in which a sphere having a smooth spherical to surface is molded, following which a plurality of grooves or holes are machined into the surface of the sphere; or a method in which the core body is molded under applied heat and pressure in a mold having a cavity with a plurality of ridges or projections formed therein, at which time the ridges or projections are transferred to the surface of the core body, forming the plurality of grooves or holes. When industrializing production of the golf ball, from the standpoint of production efficiency, it is preferable to use the method of transferring ridges or projections in the mold cavity during core molding.

Next, a second polybutadiene rubber having a higher hardness than the core body is filled into the grooves or holes, thereby producing the core. The method for doing so is not particularly limited, although suitable use can be made of the method of using a sheet of the above polybutadiene rubber composition to form a pair of half-cups, placing the resulting pair of polybutadiene rubber half-cups over the core body so as to encase it, vulcanizing/molding the half-cups under applied pressure, and subsequently abrading the surface of the vulcanizate until the surface of the core body is exposed, thereby producing a core in which the second polybutadiene rubber having a higher hardness than the surface hardness of the core body has been filled into the grooves or holes formed in the core body surface.

At this time, molding/vulcanization of the polybutadiene rubber half-cups may be carried out by subjecting an unvulcanized sheet of the rubber material to semi-vulcanization (primary vulcanization) so as to produce semi-vulcanized half-cups and then placing these half-cups over the core body and carrying out full vulcanization (secondary vulcanization). Alternatively, a sheet of the unvulcanized rubber material may be stamped into hemispherical shapes to produce unvulcanized half-cups, which are then placed over the core body and subjected to full vulcanization in a single operation.

Next, the cover which encases the core is described.

The cover material is not particularly limited. Use can be made of known materials such as various ionomer resins and urethane elastomers that are used in golf balls. A cover having a structure of one layer or, in some cases, two or more layers, may be formed using these materials.

To realize an even further spin rate-lowering effect in the ball, it is especially preferable to use a highly neutralized ionomeric material in the layer adjoining the core. Specifically, it is preferable to use a material obtained by blending components (i) to (iv) below:

100 parts by weight of a resin component composed of, in admixture, (i) a base resin of (i-1) an olefin-unsaturated carboxylic acid random copolymer and/or a metal ion neutralization product of an olefin-unsaturated carboxylic acid random copolymer mixed with (i-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (ii) a non-ionomeric thermoplastic elastomer in a weight ratio between 100:0 and 50:50;

(iii) from 5 to 80 parts by weight of a fatty acid and/or fatty acid derivative having a molecular weight of from 228 to 1,500; and (iv) from 0.1 to 17 parts by weight of a basic inorganic metal compound capable of neutralizing un-neutralized acid groups in components (i) and (iii).

In particular, when using a mixed material of components (i) to (iv), it is preferable to utilize one in which at least 70% of the acid groups are neutralized.

When the cover has two or more layers, it is preferable for the material making up the outermost layer to be composed primarily of an ionomer resin or a urethane material, especially an ionomer resin.

To obtain the cover in this invention, use can be made of, for example, the method of placing the core within a mold, heating, mixing and melting the above mixture and then injection-molding it over the core, thereby encasing the core periphery with the desired cover. Production of the cover product may be carried out at this time in a state that ensures excellent thermal stability, flowability and moldability. As a result, the golf ball that is ultimately obtained has a high rebound, in addition to which the feel at impact is good and the scuff resistance is excellent. Another cover-forming method that may be used involves molding a pair of hemispherical half-cups beforehand from the cover material, enveloping the core with these half-cups, and molding under applied pressure at between 120° C. and 170° C. for a period of from 1 to 5 minutes.

When the cover is composed of one layer, the thickness thereof may be set to from 0.3 to 3 mm. When the cover is formed of two layers, the outer cover layer thickness may be set in the range of 0.3 to 2.0 mm and the inner cover layer thickness may be set in the range of 0.3 to 2.0 mm. The Shore D hardnesses of the respective layers making up the cover (cover layers), although not particularly limited, are set to preferably at least 40, and more preferably at least 45, but preferably not more than 70, and more preferably not more than 65.

The cover making up the ball surface has a surface hardness which is not particularly limited. On the JIS-C hardness scale, the hardness is preferably 75 or more, more preferably 80 or more, and even more preferably 85 or more. The upper limit in this surface hardness is preferably not more than 99, more preferably not more than 97, and even more preferably not more than 95. On the Shore D hardness scale, the hardness is preferably 49 or more, more preferably 53 or more, and even more preferably 57 or more. The upper limit in this surface hardness is preferably not more than 67, more preferably not more than 66, and even more preferably not more than 64.

Although not particularly limited, it is preferable for this cover hardness to be set higher than the hardness of the groove portions or hole portions of the core. In this way, the spin rate on driver shots can be better reduced. At this time, the difference between the cover hardness and the surface hardness of the groove portions or hole portions of the core is not particularly limited. However, on the JIS-C hardness scale, this difference is preferably 1 or more, more preferably 4 or more, and even more preferably 7 or more. The upper limit in this hardness difference is preferably not more than 25, more preferably not more than 20, and even more preferably not more than 16.

Dimples may be formed on the cover surface in the usual manner. In addition, the surface may be suitably painted. The golf ball of the invention may be produced as a two-piece golf ball having a core and a cover. Alternatively, a multi-piece golf ball may be produced in which one or more intermediate layer is formed between the core and the cover.

EXAMPLES

The following Examples and Comparative Examples are provided to illustrate the invention, and are not intended to limit the scope thereof.

Examples 1 to 3, Comparative Example 1

Formation of Core:

A rubber composition of Formulation A shown in Table 1 below was prepared, following which the composition was vulcanized and molded at 155° C. for 13 minutes, thereby producing 40.2 mm diameter spheres having a smooth spherical surface. Next, cylindrical holes of the dimensions shown in Table 3 were formed in the arrangement shown in FIG. 2 with a milling machine, giving core bodies for Examples 1 and 2. In addition, grooves of the dimensions shown in Table 3 were formed on the surface of an identical sphere in the grid-like arrangement shown in Table 1 by turning on a lathe, giving a core body for Example 3. Also, the same rubber composition was vulcanized/molded at 155° C. for 15 minutes to produce a 40.2 mm diameter sphere, giving a core for Comparative Example 1 in which grooves and holes were not formed and the spherical surface remained smooth. The amount of compressive deformation (deflection) by the resulting core bodies for Examples 1 to 3 and the core for Comparative Example 1 were measured by the following method. The results are shown in Table 3.

Next, a rubber composition of Formulation B shown in Table 1 below was prepared. This rubber composition was set in a mold having a semi-spherical cavity, placed between this and a positive form of the same radius as the core, and heated at 155° C. for 1 minute, following which the composition was removed from the mold, thereby producing a rubber half-cup. A pair of such half-cups produced in this way were arranged so as to cover the core body in which holes or grooves had been formed and vulcanized/molded at 155° C. for 13 minutes, giving a sphere in which the surface of the core body was covered by the rubber material for filling the holes or grooves. The surface of the resulting sphere was abraded until the surface of the core body became exposed, thereby producing cores in each of Examples 1 to 3. The surface hardnesses at the surface of the exposed core body and at the rubber-filled groove portions or hole portions were measured. The surface hardness of the core for Comparative Example 1 was similarly measured. The results are shown in Table 3.

Formation of Cover:

A cover material of Formulation a shown in Table 2 was injection-molded over the periphery of the respective cores obtained for Examples 1 to 3 and Comparative Example 1 to form in each case a cover having a thickness of 1.25 mm, thereby producing golf balls. Identical dimples were formed at this time on the surface of the cover in each golf ball. The surface hardness of the cover was measured for each of the resulting golf balls. The results are shown in Table 3.

Evaluation of Performance:

The compressive deformation (deflection) of the ball and the spin rate on shots with a driver (W #1) were measured by the following methods for each golf ball. The results are shown in Table 3.

Compressive Deformation (Deflection) of Core and Ball:

The core or ball is placed on a hard plate and the amount of deflection when compressed under a final load of 1,275 N (130 kgf) from an initial load of 98 N (10 kgf) is measured. Measurement is carried out after temperature conditioning the specimen at 23.9° C.

Spin Rate on Shots with Driver (W #1):

A PHYZ Driver (loft angle, 10.5°) manufactured by Bridgestone Sports Co., Ltd. is mounted on a golf swing robot and the rate of backspin by the ball when struck at a head speed (HS) of 45 m/s is measured.

Examples 4 to 6, Comparative Examples 2 to 4

Formation of Core:

In these prospective examples, a rubber composition of Formulation A (Comparative Examples 2 to 4) or Formulation D (Examples 4 to 6) shown in Table 1 below is prepared, following which it is vulcanized/molded at 155° C. for 13 minutes, thereby producing a 40.2 mm diameter sphere having a smooth spherical surface. Next, cylindrical holes of the dimensions shown in Table 3 are formed in the arrangement shown in FIG. 2 with a milling machine, giving core bodies for Example 6 and Comparative Examples 2 and 3. Also, grooves of the dimensions shown in Table 3 are formed on the surface of identical spheres in the grid-like arrangement shown in Table 1 by turning on a lathe, giving core bodies for Examples 4 and 5 and for Comparative Example 4. The amount of compressive deformation (deflection) by the resulting core bodies for Examples 4 to 6 and the resulting core bodies for Comparative Examples 2 to 4 is measured by the above-described method. The results are shown in Table 3.

Next, rubber compositions of Formulation B (Example 6), Formulation C (Comparative Examples 2 to 4) and Formulation E (Examples 4 and 5) shown in Table 1 below are prepared. These rubber compositions are each set in a mold having a semi-spherical cavity, placed between this and a positive form of the same radius as the core, and heated at 155° C. for 1 minute, following which the composition is removed from the mold, thereby producing a rubber half-cup. A pair of such half-cups produced in this way are arranged so as to cover the core body in which holes or grooves have been formed and vulcanized/molded at 155° C. for 13 minutes, giving a sphere in which the surface of the core body is encased by the rubber material for filling the grooves or holes. The surface of the resulting sphere is abraded until the surface of the core body becomes exposed, thereby producing cores in each of Examples 4 to 6 and Comparative Examples 2 to 4. The surface hardnesses at the surface of the exposed core body and at the rubber-filled groove portions or hole portions are measured for each core. The results are shown in Table 3.

Formation of Cover:

Cover materials of Formulation a (Example 4 and Comparative Examples 2 to 4), Formulation b (Example 6) and Formulation c (Example 5) shown in Table 2 are injection-molded over the respective cores obtained for Examples 4 to 6 and Comparative Example 2 to 4 to form a cover having a thickness of 1.25 mm, thereby producing golf balls. Identical dimples as in Example 1 are formed at this time on the surface of the cover in each golf ball. The surface hardness of the cover is measured for each of the resulting golf balls. The results are shown in Table 3.

Evaluation of Performance:

The compressive deformation (deflection) of the ball and the spin rate on shots with a driver (W #1) are measured in the same way as in Example 1 above for each of the golf balls. The results are shown in Table 3.

TABLE 1

Core and groove formulations (parts by weight)

| | A | B | C | D | E |
|---|---|---|---|---|---|
| Polybutadiene | 100 | 100 | 100 | 100 | 100 |
| Zinc acrylate | 20.1 | 32.7 | 18.0 | 19.0 | 45.0 |
| Organic peroxide (I) | 0.6 | 0.6 | 0.6 | 0.6 | 0.6 |
| Organic peroxide (II) | 1.2 | 1.2 | 1.2 | 1.2 | 1.2 |
| Antioxidant | 0.1 | 0.1 | 0.1 | 0.1 | 0.1 |
| Zinc oxide | 21.3 | 16.0 | 22.1 | 21.7 | 10.7 |
| Zinc salt of pentachlorothiophenol | 0.1 | 0.1 | 0.1 | 0.1 | 0.1 |

Polybutadiene: Available under the trade name "BR01" from JSR Corporation

Zinc acrylate: Available as "ZN-DA85S" from Nippon Shokubai Co., Ltd.

Organic Peroxide (I): Dicumyl peroxide, available under the trade name "Percumyl D" from NOF Corporation Organic Peroxide (II): A mixture of 1,1-di(t-butylperoxy) cyclohexane and silica, available under the trade name "Perhexa C40" from NOF Corporation Antioxidant: 2,2-Methylenebis(4-methyl-6-butylphenol), available under the trade name "Nocrac NS-6" from Ouchi Shinko Chemical Industry Co., Ltd.

Zinc oxide: Available as "Zinc Oxide Grade 3" from Sakai Chemical Co., Ltd.

Zinc salt of pentachlorothiophenol:
Available from Zhejiang Cho & Fu Chemical Co., Ltd.

TABLE 2

| Cover formulations (parts by weight) | | | |
|---|---|---|---|
| | a | b | c |
| Himilan 1605 | 30 | 30 | 30 |
| Himilan 1855 | 30 | 50 | 10 |
| AM7327 | 40 | 20 | 60 |
| Titanium oxide | 4 | 4 | 4 |

Himilan® 1605: An ionomer resin from Dow-Mitsui Polychemicals Co., Ltd.

Himilan® 1855: An ionomer resin from Dow-Mitsui Polychemicals Co., Ltd.

AM7327: An ionomer resin from Dow-Mitsui Polychemicals Co., Ltd.

Titanium oxide: from Sakai Chemical Co., Ltd.

In the golf ball of Comparative Example 2, the core has a surface hardness which is higher for the core body than for the hole portions. As a result, compared with the ball in Example 1 which, aside from the hole portions, has the same specifications, the spin rate is likely to be high and the distance thus inferior.

In the golf ball of Comparative Example 3, the core has a surface hardness which is higher for the core body than for the hole portions. As a result, compared with the ball in Example 1 which, aside from the hole portions, has the same specifications, the spin rate is likely to be high and the distance thus inferior.

In the golf ball of Comparative Example 4, the core has a surface hardness which is higher for the core body than for the groove portions. As a result, compared with the ball in Example 1 which, aside from the groove portions, has the same specifications, the spin rate is likely to be high and the distance thus inferior.

Japanese Patent Application No. 2021-197470 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

TABLE 3

| Specifications and Evaluation Results | | | | | | | | | | | | |
|---|---|---|---|---|---|---|---|---|---|---|---|---|
| | | | Example | | | | | | Comparative Example | | | |
| | | | 1 | 2 | 3 | 4 | 5 | 6 | 1 | 2 | 3 | 4 |
| Core | Core body | Diameter (mm) | 40.2 | 40.2 | 40.2 | 40.2 | 40.2 | 40.2 | 40.2 | 40.2 | 40.2 | 40.2 |
| | | Compressive deformation (mm) | 4.05 | 4.05 | 4.05 | 4.25 | 4.25 | 4.25 | 4.05 | 4.05 | 4.05 | 4.05 |
| | | Material | A | A | A | D | D | D | A | A | A | A |
| | | Surface hardness (JIS-C) | 78.7 | 78.2 | 77.8 | 76.5 | 76.5 | 76.5 | 77.2 | 78.7 | 78.7 | 77.8 |
| | Grooves/ Holes | Shape | cylindrical | cylindrical | grid | grid | grid | cylindrical | — | cylindrical | cylindrical | grid |
| | | Width, diameter (mm) | 2.5 | 2.0 | 1.5 | 1.5 | 1.5 | 2.5 | — | 2.5 | 2.0 | 1.5 |
| | | Depth (mm) | 1.0 | 0.5 | 0.5 | 0.5 | 0.5 | 1.0 | — | 1.0 | 0.5 | 0.5 |
| | | Spacing between adjoining grooves or holes (mm) | 5.0 | 5.0 | 5.0 | 5.0 | 5.0 | 5.0 | — | 5.0 | 5.0 | 5.0 |
| | | Material | B | B | B | E | E | B | — | C | C | C |
| | | Surface hardness (JIS-C) | 80.0 | 79.6 | 79.6 | 89.5 | 89.5 | 80.0 | — | 76.6 | 76.6 | 76.4 |
| | Proportion of core surface area occupied by grooves or holes (%) | | 18.2 | 11.6 | 42.0 | 42.0 | 42.0 | 18.2 | 0 | 18.2 | 11.6 | 42.0 |
| Cover | Thickness (mm) | | 1.25 | 1.25 | 1.25 | 1.25 | 1.25 | 1.25 | 1.25 | 1.25 | 1.25 | 1.25 |
| | Surface hardness (JIS-C) | | 90.9 | 90.9 | 90.9 | 90.9 | 88.3 | 94.8 | 90.9 | 90.9 | 90.9 | 90.9 |
| | Material | | a | a | a | a | c | b | a | a | a | a |
| | Material hardness (Shore D) | | 55 | 55 | 55 | 55 | 53 | 58 | 55 | 55 | 55 | 55 |
| Surface hardness relationships | Grooves or holes - Core (JIS-C) | | 1.3 | 1.4 | 1.8 | 13.0 | 13.0 | 3.5 | — | −2.1 | −2.1 | −1.4 |
| | Cover layer - Grooves or holes (JIS-C) | | 10.9 | 11.3 | 11.3 | 1.4 | −1.2 | 14.8 | — | 14.3 | 14.3 | 14.5 |
| Compressive deformation of ball (mm) | | | 3.68 | 3.67 | 3.65 | 3.65 | 3.62 | 3.68 | 3.70 | 3.72 | 3.71 | 3.74 |
| Spin rate on shots with a driver (rpm) | | | 2,655 | 2,670 | 2,620 | 2,584 | 2,649 | 2,548 | 2,717 | 2,752 | 2,745 | 2,780 |

As demonstrated by the results in Table 3, it is apparent that the golf balls in Examples 1 to 6 according to the invention hold down the spin rate on driver shots while maintaining a good rebound (compressive deformation (deflection)), enabling the distance to be effectively increased. On the other hand, it is apparent that the golf balls in Comparative Examples 1 to 4 are inferior to those in Examples 1 to 6 with regard to reduction in the spin rate.

The golf ball of Comparative Example 1 has no grooves or holes in the core. As a result, compared with the balls in Examples 1 to 6, the spin rate is likely to be high and the distance thus inferior.

The invention claimed is:

1. A method for manufacturing a golf ball comprising a core and a cover, wherein the core has a core body made of a first polybutadiene rubber and having a surface with a plurality of grooves or holes thereon, which grooves or holes are filled with a second polybutadiene rubber of a differing composition from the first polybutadiene rubber, and wherein the polybutadiene rubber-filled groove portions or hole portions have a higher surface hardness than the core body, comprising the steps of:

producing a core body that is made of a first polybutadiene rubber and has a surface with a plurality of grooves or holes thereon;

filling the grooves or holes formed at the surface of the core body with a second polybutadiene rubber having a higher hardness than the surface hardness of the core body so as to produce a core having a smooth spherical surface; and forming a cover around the core, either directly on the core or over an intervening intermediate layer.

2. The manufacturing method of claim 1, wherein the core body is produced by vulcanizing/molding the first polybutadiene rubber under applied pressure in a mold having a cavity with a plurality of ridges or projections formed therein, at which time the ridges or projections are transferred to the surface of the core body, forming the plurality of grooves or holes.

3. The manufacturing method of claim 1, wherein the core body is produced by vulcanizing/molding the first polybutadiene rubber under applied pressure to form a sphere, and subsequently machining a plurality of grooves or holes in the surface of the sphere.

4. The manufacturing method of claim 1, wherein the core in which the plurality of grooves or holes formed at the surface of the core body are filled with a polybutadiene rubber having a higher hardness than the surface hardness of the core body is produced by placing a pair of half-cups formed of the second polybutadiene rubber over the core body so as to encase it, vulcanizing/molding the second polybutadiene rubber under applied pressure, and subsequently abrading the surface of the second polybutadiene rubber encasing the core body until the surface of the core body is exposed.

* * * * *